US009396614B2

(12) United States Patent
Lee

(10) Patent No.: US 9,396,614 B2
(45) Date of Patent: Jul. 19, 2016

(54) GAMING MACHINE AND METHOD OF ALLOWING PLAYERS TO PLAY GAMING MACHINES

(71) Applicant: Konami Gaming, Inc., Las Vegas, NV (US)

(72) Inventor: Arthur Lee, Las Vegas, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 129 days.

(21) Appl. No.: 13/793,073

(22) Filed: Mar. 11, 2013

(65) Prior Publication Data

US 2013/0260862 A1 Oct. 3, 2013

(30) Foreign Application Priority Data

Mar. 27, 2012 (AU) ..... 2012201787

(51) Int. Cl.
*G07F 17/34* (2006.01)
*G07F 17/32* (2006.01)

(52) U.S. Cl.
CPC ..... *G07F 17/34* (2013.01); *G07F 17/3267* (2013.01)

(58) Field of Classification Search
CPC . G07F 17/34; G07F 17/3267; G07F 17/3213; G07F 17/3244
See application file for complete search history.

(56) References Cited

U.S. PATENT DOCUMENTS

2003/0073483 A1* 4/2003 Glavich et al. ..... 463/20
2004/0162134 A1* 8/2004 Walker et al. ..... 463/20
2004/0204234 A1 10/2004 Walker et al.
2004/0209685 A1* 10/2004 Lucchesi et al. ..... 463/35
2005/0282613 A1* 12/2005 Pryzby et al. ..... 463/20
2006/0025201 A1* 2/2006 Van Asdale ..... 463/20
2010/0029362 A1 2/2010 Bennett, III et al.
2010/0113136 A1* 5/2010 Joshi et al. ..... 463/20
2012/0034967 A1* 2/2012 Owen et al. ..... 463/20

OTHER PUBLICATIONS

Examiner's First Report (Application No. AU 2012201787)—Issued May 10, 2012.
Patent Examination Report No. 2 (Application No. AU 2012201787)—Issued Nov. 9, 2012.

* cited by examiner

*Primary Examiner* — James S McClellan
*Assistant Examiner* — Kevin Carter
(74) *Attorney, Agent, or Firm* — Howard & Howard Attorneys PLLC

(57) ABSTRACT

A gaming machine and method are provided which allow a player to play a gaming machine. The gaming machine and method allow a player to make a wager on a first primary game and randomly generate an outcome of the first primary game. The gaming machine determines if an anticipation event triggering condition has occurred based at least in part on an anticipation event probability associated with the first primary game, displays an anticipation event on the display device if the anticipation event triggering condition has occurred, and displays the first primary game outcome on the display device. A number of anticipation events that have occurred during the first gaming session is calculated, and the anticipation event probability is modifying based at least in part on the number of anticipation events that have occurred. The player is awarded an award if the first primary game outcome is a winning outcome.

27 Claims, 6 Drawing Sheets

GAMING MACHINE AND METHOD OF ALLOWING PLAYERS TO PLAY GAMING MACHINES

CROSS-REFERENCE TO RELATED APPLICATION

This application claims priority to Australian Patent Application No. 2012201787, filed Mar. 27, 2012, the disclosure of which is hereby incorporated by reference in its entirety.

FIELD OF THE INVENTION

The subject matter disclosed herein relates generally to video gaming machines and more particularly, to an apparatus and method for allowing players to play gaming machines.

BACKGROUND OF THE INVENTION

Gaming machines, such as slot machines, are a cornerstone of the gaming industry. Generally, the popularity of such machines with players is dependent on the perceived likelihood of winning money at the particular game and the intrinsic entertainment value of the game relative to other available gaming options.

At least some known gaming machines include a video display device to display a reel game that includes a plurality of reels, wherein each reel includes a plurality of symbols. During game play, the gaming machine accepts a wager from a player to initiate a game, and randomly generates an outcome of the game. The gaming machine spins the reels, and sequentially stops each reel to display the generated combination of symbols on the reels. The gaming machine then awards the player an award if the generated outcome is a winning outcome.

At least some known gaming machines provide notifications indicative of a potential winning combination to the player, even if the generated outcome does not include a winning combination. For example, potential winning notifications may be displayed when a majority of the symbols included in the winning combination are present on the stopped reels with one or more reels are still spinning. Known potential winning notifications may include enhanced lighting effects or an extended spin duration of the remaining spinning reels.

Gaming machines display the potential winning notifications to induce anticipation to the player of a winning outcome. At least some known gaming machines display the potential winning combination when a triggering condition occurs in the generated outcome such as, for example, the appearance of special symbols in the stopped reels. Because the potential winning combination appears each time the triggering condition occurs, a player may associate the appearance of these triggering symbols with a non-winning combination. As such, the player may become frustrated each time the potential winning notification appears, which reduces the anticipation induced to player from the potential winning notification.

New features are necessary to appeal to player interest and enhance excitement in order to entice longer play and satisfy demands of operators for interesting games and increased profitability. The present invention is directed to satisfying these needs.

SUMMARY OF THE INVENTION

In one aspect of the present invention, a method of allowing a player to play a gaming machine is provided. The method includes the steps of allowing a player to initiate a first gaming session, wherein the first gaming session includes one or more primary games to be played on the gaming machine. The player is allowed to make a wager on a first primary game and an outcome of the first primary game is randomly generated. The method also includes the steps of determining if an anticipation event triggering condition has occurred based at least in part on an anticipation event probability associated with the first primary game, displaying an anticipation event on the display device if the anticipation event triggering condition has occurred, and displaying the first primary game outcome on the display device. A number of anticipation events that have occurred during the first gaming session is calculated, and the anticipation event probability is modifying based at least in part on the number of anticipation events that have occurred. The player is awarded an award if the first primary game outcome is a winning outcome.

In another aspect of the present invention, a gaming machine is provided. The gaming machine includes a display device, a user input device that is configured to generate a signal indicative of a player's selection input, and a controller that is operatively coupled to the display device and the user input device. The controller is configured to receive, from the user input device, a signal indicative of a player's selection to initiate a first gaming session, receive a signal indicative of a player's wager associated with the first primary game, and generate an outcome of the first primary game. The controller is also configured to determine if an anticipation event triggering condition has occurred based at least in part on an anticipation event probability associated with the first primary game, display an anticipation event on the display device if the anticipation event triggering condition has occurred, and display the first primary game outcome on the display device. The controller calculates a number of anticipation events that have occurred during the first gaming session, and modifies the anticipation event probability based at least in part on the number of anticipation events that have occurred. The controller also awards the associated player an award if the first primary game outcome is a winning outcome.

In yet another aspect of the present invention, a gaming system is provided. The gaming system includes a plurality of gaming machines and a system controller that is coupled to each gaming machine. Each gaming machine includes a user selection input device, a display device, and a game controller for allowing an associated player to initiate a gaming session on an associated gaming machine. The system controller is configured to receive a signal indicative of the player's selection to initiate a first gaming session, receive a signal indicative of the player's wager associated with the first primary game, and generate an outcome of the first primary game. The system controller is also configured to determine if an anticipation event triggering condition has occurred based at least in part on an anticipation event probability associated with the first primary game, display an anticipation event on the associated display device if the anticipation event triggering condition has occurred, and display the first primary game outcome on the associated display device. The system controller calculates a number of anticipation events that have occurred during the first gaming session of the associated gaming machine, and modifies the anticipation event probability based at least in part on the number of anticipation events that have occurred. The system controller also awards the player an award if the first primary game outcome is a winning outcome.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
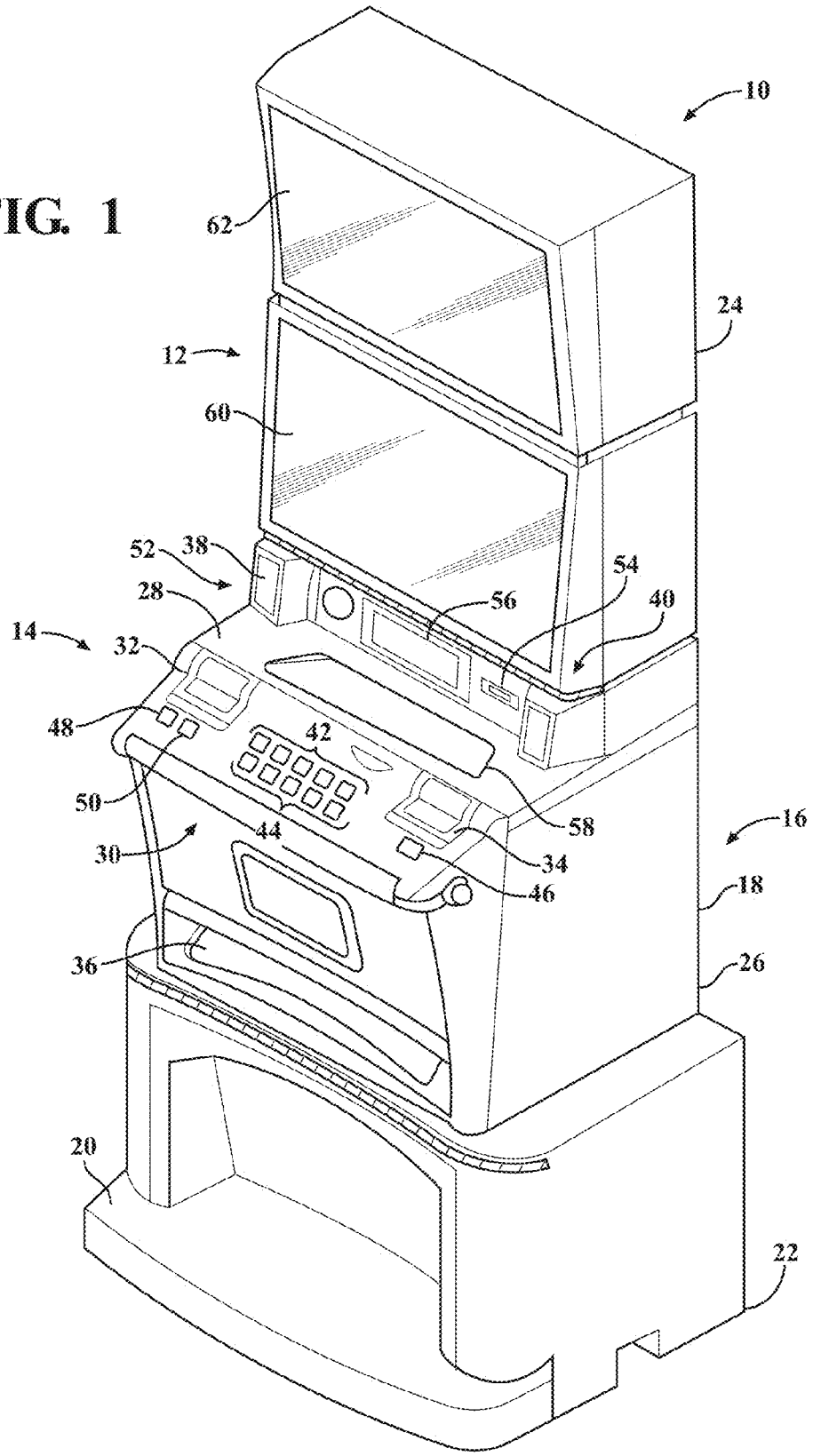
FIG. 1 is a perspective view of an exemplary gaming machine of the present invention.

With reference to the drawings and in operation, the present invention overcomes at least some of the disadvantages of known gaming machines by providing a gaming machine 10 that displays an anticipation event associated with a potential winning outcome and/or bonus feature during game play, and modifies the probability of the anticipation event occurring during subsequent game plays. More specifically, the gaming machine 10 initiates a gaming session, generates a first primary game outcome, and determines if an anticipation event triggering condition has occurred in the first primary game outcome based on an anticipation event probability. The gaming machine 10 also calculates the number of anticipation events that have occurred during the gaming session, and calculates a modified anticipation event probability that is used during a subsequent second primary game that is played by the player. By displaying an anticipation event that is associated with the potential winning outcome and/or the bonus feature, the player's interest and anticipation in the outcome is increased. In addition, by modifying the probability of the anticipation event occurring during subsequent game plays, the enjoyment of the game play is improved, and the amount of time that the gaming machine is played by patrons of a gaming establishment is thereby increased.

In general, the gaming machine 10 allows a player to play a plurality of video slot games. The gaming machine 10 allows a player to initiate a gaming session, displays a first primary game, accepts a wager on the first primary game, generates an outcome of the first primary game, and awards the player an award if the primary game outcome is a winning outcome. In addition, the gaming machine 10 determines if an anticipation event triggering condition has occurred in the first primary game based at least in part on an anticipation event probability associated with the first primary game, and displays the anticipation event if the anticipation event triggering condition has occurred. The gaming machine then calculates a number of anticipation events that have occurred during the gaming session, and modifies the anticipation event probability for use in a second primary game that is played after the first primary game. The modified anticipation event probability is calculated based at least in part on the number of anticipation events that have occurred. The gaming machines allows the player to make a wager on the second primary game, generates an outcome of the secondary game, and awards the player an award based on the second primary game outcome. In addition, the gaming machine determines if the anticipation event triggering condition has occurred in the second primary game based at least in part on the modified anticipation event probability, and displays the anticipation event during the second game if the anticipation event triggering condition has occurred.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

An exemplary technical effect of the methods, systems, and computers described herein includes at least one of (a) allowing a player to initiate a first gaming session including one or more primary games to be played on a gaming machine, (b) randomly generating an outcome of a first primary game, (c) determining if an anticipation event triggering condition has occurred based at least in part on an anticipation event probability associated with the first primary game, (d) displaying an anticipation event on the display device if the anticipation event triggering condition has occurred, (e) displaying the first primary game outcome on the display device, (f) calculating a number of anticipation events that have occurred during the first gaming session, and (g) modifying the anticipation event probability based at least in part on the number of anticipation events that have occurred.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 2:
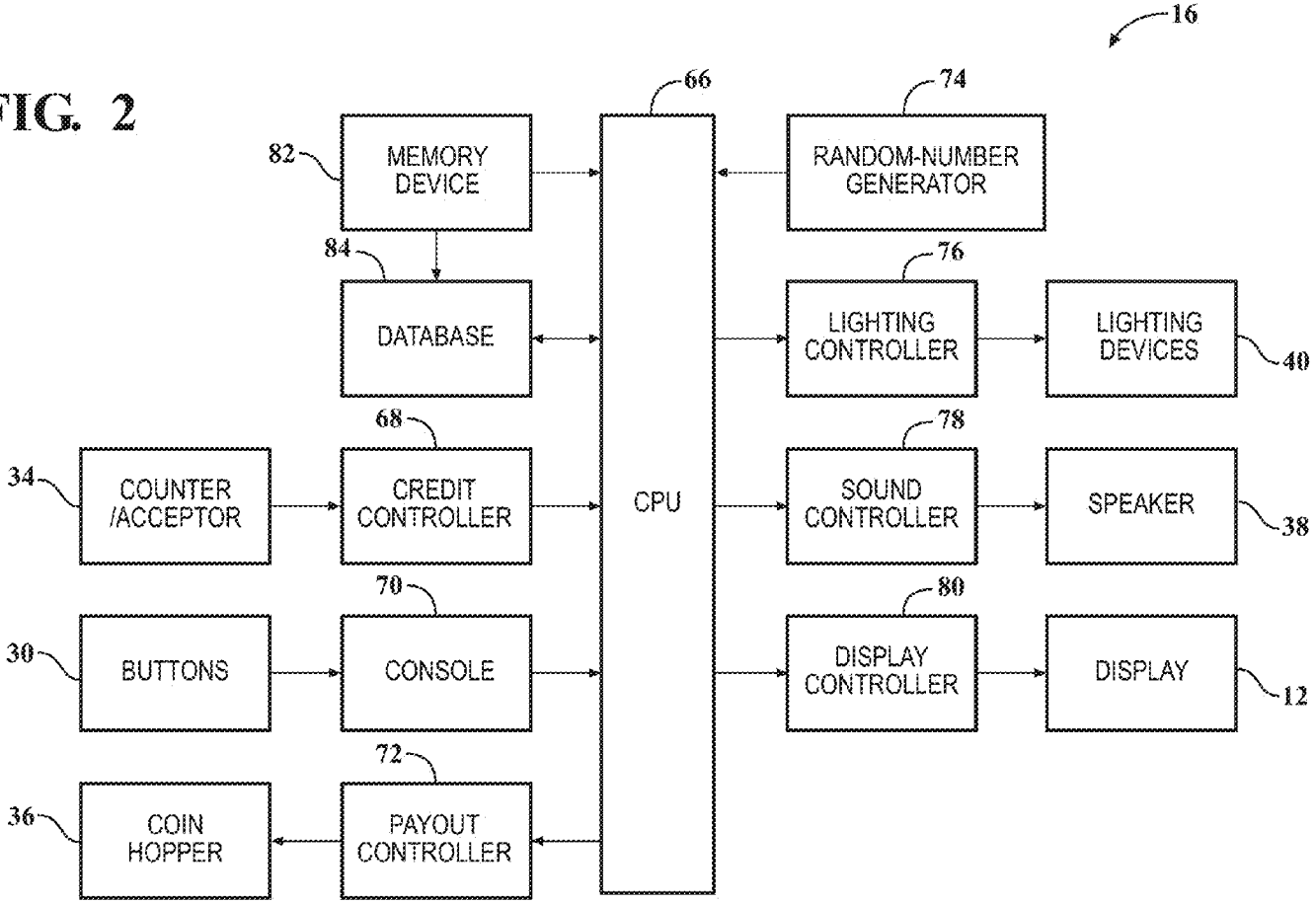
FIG. 2 is a schematic representation of the gaming machine shown in FIG. 1.

FIG. 1 is a perspective view of an exemplary the gaming machine 10. FIG. 2 is a schematic representation of the gaming machine 10. A preferred embodiment of the present invention is a video gaming machine preferably installed in a casino. In the illustrated embodiment, the gaming machine 10 includes a display device 12 for displaying a plurality of games, a user input device 14 to enable a player to interface with the gaming machine 10, and a gaming controller 16 that is operatively coupled to the display device 12 and the user input device 14 to enable a player to play games displayed on the display device 12. The gaming machine 10 also includes a box-shaped modular cabinet assembly 18 that is configured to support display device 12, user input device 14, and/or gaming controller 16 from a gaming stand 20 and/or a supporting surface 22. One such cabinet is disclosed in commonly owned US Patent Application Publication No. 2010/0087259 (Ser. No. 12/287,428), filed Oct. 8, 2008, which is hereby incorporated by reference.

Cabinet assembly 18 includes a first cabinet, i.e. an upper cabinet 24, and a second cabinet, i.e. a lower cabinet 26. The display device 12 is coupled to the upper cabinet 24, and is positioned within the upper cabinet 24 such that the display device 12 is accessible by the player. The user input device 14 is coupled to the lower cabinet 26 such that the user input device 14 may be accessed by the player. Moreover, the user input device 14 is coupled to a top surface 28 of the lower cabinet 26 such that the user input device 14 is oriented towards the player to enable the player to easily operate the user input device 14 to facilitate play of the games displayed on the display device 12. In one embodiment, the gaming controller 16 is positioned within the cabinet assembly 18. Alternatively, the gaming controller 16 may be separated from the cabinet assembly 18, and connected to components of the gaming machine 10 through a network such as, for example, a local area network (LAN), a wide area network (WAN), dial-in-connections, cable modems, wireless modems, and/or special high-speed Integrated Services Digital Network (ISDN) lines.

In one embodiment, the user input device 14 includes a plurality of input buttons 30, a coin slot 32, and/or a bill acceptor 34. Coin slot 32 includes an opening that is configured to receive coins and/or tokens deposited by the player into the gaming machine 10. The gaming machine 10 converts a value of the coins and/or tokens to a corresponding amount of gaming credits that are used by the player to wager on games played on the gaming machine 10.

The bill acceptor 34 includes an input and output device that is configured to accept a bill, a ticket, and/or a cash card into the gaming machine 10 to enable an amount of gaming credits associated with a monetary value of the bills, ticket, and/or cash card to be credited to the gaming machine 10. Moreover, the gaming machine 10 may also utilize a cashless wagering system (not shown), such as a ticket in ticket out (TITO) system (not shown). In one embodiment, the bill acceptor 34 also includes a printer (not shown) that is configured to dispense a printed voucher ticket that includes information indicative of an amount of credits and/or money paid out to the player by the gaming machine 10 during a gaming session. The voucher ticket may be used at other gaming machines, or redeemed for cash, and/or other items as part of the casino cashless system.

A coin tray 36 is coupled to the lower cabinet 26 and is configured to receive a plurality of coins that are dispensed from the gaming machine 10. One or more speakers 38 are installed inside the cabinet assembly 18 to generate voice announcements and/or sound effects associated with game play. The gaming machine 10 also includes one or more lighting devices 40 that are configured to blink and/or change brightness and color in specific patterns to produce lighting effects to enhance a visual gaming experience for the player.

In one embodiment, the input buttons 30 include a plurality of BET switches 42 for inputting a wager on a game, a plurality of selection switches 44 for selecting a betting line and/or card, a MAXBET switch 46 for inputting a maximum wager, a PAYOUT switch 48 for ending a gaming session and dispensing accumulated gaming credits to the player, and a start button, i.e. a SPIN/DEAL button 50 to initiate an output of a game.

In the illustrated embodiment, the BET switches 42 include five switches from 1BET to 5BET to enable a player to wager between a minimum bet up to 5× minimum bet. Each selection switch 44 corresponds to a betting line such as, for example, a payline and/or symbol for a reel game, one or more cards for a card game, and/or a symbol for a roulette game, to enable a player to associate a wager with one or more betting lines. The MAXBET switch 46 enables a player to input the maximum bet that a player can spend against one time of a game. The PAYOUT switch 48 enables a player to receive the amount of money and/or credits awarded to the player during a gaming session, which has been credited onto the gaming machine 10.

The gaming machine 10 also includes a player tracking device 52 that is coupled to the gaming controller 16 for identifying the player and/or a player tracking account that is associated with the player. The player tracking account may include, but is not limited to, gaming credits available to the player for use in playing the gaming machine 10. The player tracking device 52 is configured to communicate player account information between a player tracking controller (not shown) and the gaming machine 10. For example, the player tracking device 52 may be used to track bonus points and/or credits awarded to the player during a gaming session and/or track bonus and/or credits downloaded to the gaming machine 10 from the player tracking system.

The player tracking device 52 is coupled to the cabinet assembly 18 and includes a player identification card reader 54, a data display 56, and a keypad 58. The player identification card reader 54 is configured to accept a player tracking card (not shown) inserted by the player, and read information contained on the player tracking card to identify the player account information. The player identification card reader 54 may include, but is not limited to, a barcode reader, a magnetic card reader, and/or a radio frequency identification (RFID) card reader. The keypad 58 is configured to accept a user selection input such as, for example, a unique player personal identification number (PIN) to facilitate enabling the gaming machine 10 to identify the player, and access player account information associated with the identified player to be displayed on the data display 56. In one embodiment, the data display 56 includes a touchscreen panel that includes the keypad 58. Alternatively, the data display 56 and the keypad 58 may be included in display device 12.

In one embodiment, the display device 12 includes a first display 60 and a second display 62. The first display 60 is configured to display a game screen 64 (shown in FIG. 3) including indicia and/or symbols for use in a game, e.g., cards used by a card game, roulette wheel and symbols used in a roulette game, and reels used in a reel game. The game screen 64 may include any type of game including, but not limited to, a video slot game, a keno game, a blackjack game, a video poker game, or any type of game which allows a player to make a wager, play a game, and potentially provide the player an award based on an outcome of the game and a paytable. The second display 62 is configured to display game play instructions (not shown) for performing the game including, but not limited to, playing instructions, paytables, paylines, betting lines and/or any other information to enable the gaming machine 10 to function as described herein. Moreover, each display 60 and 62 may be configured to display at least a portion of the game screen 64 and/or game play instructions. In one embodiment, first and second displays 60 and 62 each include a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the display device 12 and as the user input device 14.

Referring to FIG. 2, in one embodiment, the gaming controller 16 includes a processor, i.e. a central processing unit (CPU) 66, a credit controller 68, a console unit 70, a payout controller 72, a random-number generator (RNG) 74, a lighting controller 76, a sound controller 78, a display controller 80, a memory device 82, and a database 84. Memory device 82 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 66 to store, retrieve, and/or execute instructions and/or data.

The CPU 66 executes various programs, and thereby controls other components of the gaming controller 16 according to player instructions and data accepted by the user input device 14. The CPU 66 in particular executes a game program, and thereby conducts a game in accordance with the embodiments described herein. The memory device 82 stores programs and databases used by the CPU 66. Moreover, the memory device 82 stores and retrieves information in the database 84 including image data for producing game images and screens on the display device 12, and temporarily stores variables, parameters, and the like that are used by the CPU 66. In addition, the memory device 82 stores indicia, symbol weights, paytables, and/or winning combination tables which represent relationships between combinations of random numbers and types of awards. In one embodiment, the memory device 82 utilizes RAM to temporarily store programs and data necessary for the progress of the game, and EPROM to store, in advance, programs and data for controlling basic operation of the gaming machine 10, such as the booting operation thereof.

The credit controller 68 manages the amount of player's credits, which is equivalent to the amount of coins and bills counted and validated by the bill acceptor 34. The console unit 70 is coupled to the user input device 14 to monitor player selections received through the input buttons 30, and accept various instructions and data that a player enters through the input buttons 30. The payout controller 72 converts a player's credits to coins, bills, or other monetary data by using the coin tray 36 and/or dispense a credit voucher via the bill acceptor 34.

The lighting controller 76 controls one or more lighting devices 40 to blink and/or change brightness and color in specific patterns in order to produces lighting effects associated with game play. The sound controller 78 controls speakers 38 to output voice announcements and sound effects during game play. The display controller 80 controls the display device 12 to display various images on screens preferably by using computer graphics and image data stored in the memory device 82. More specifically, the display controller 80 controls video reels in a game screen displayed on the first display 60 and/or the second display 62 by using computer graphics and image data.

Random-number generator (RNG) 74 generates and outputs random numbers to the CPU 66 preferably at the start of each game. The CPU 66 uses the random numbers to determine an outcome of the primary games, anticipation events, bonus features, and/or secondary games. For example, if the primary game is a video slot game, the CPU 66 uses the RNG 74 to randomly select an arrangement of symbols to be displayed on video reels. Moreover, the CPU 66 generally uses random numbers generated by the RNG 74 to play the primary games, to initiate anticipation events, bonus features, and/or secondary games, and to determine whether or not to provide an award to a player. In addition, the CPU 66 generates game outcomes including combinations of random numbers, and compares the generated combinations with winning combinations stored in the winning combination table to determine if the generated outcome is a winning outcome that is associated with a type of award.

Figure 3:
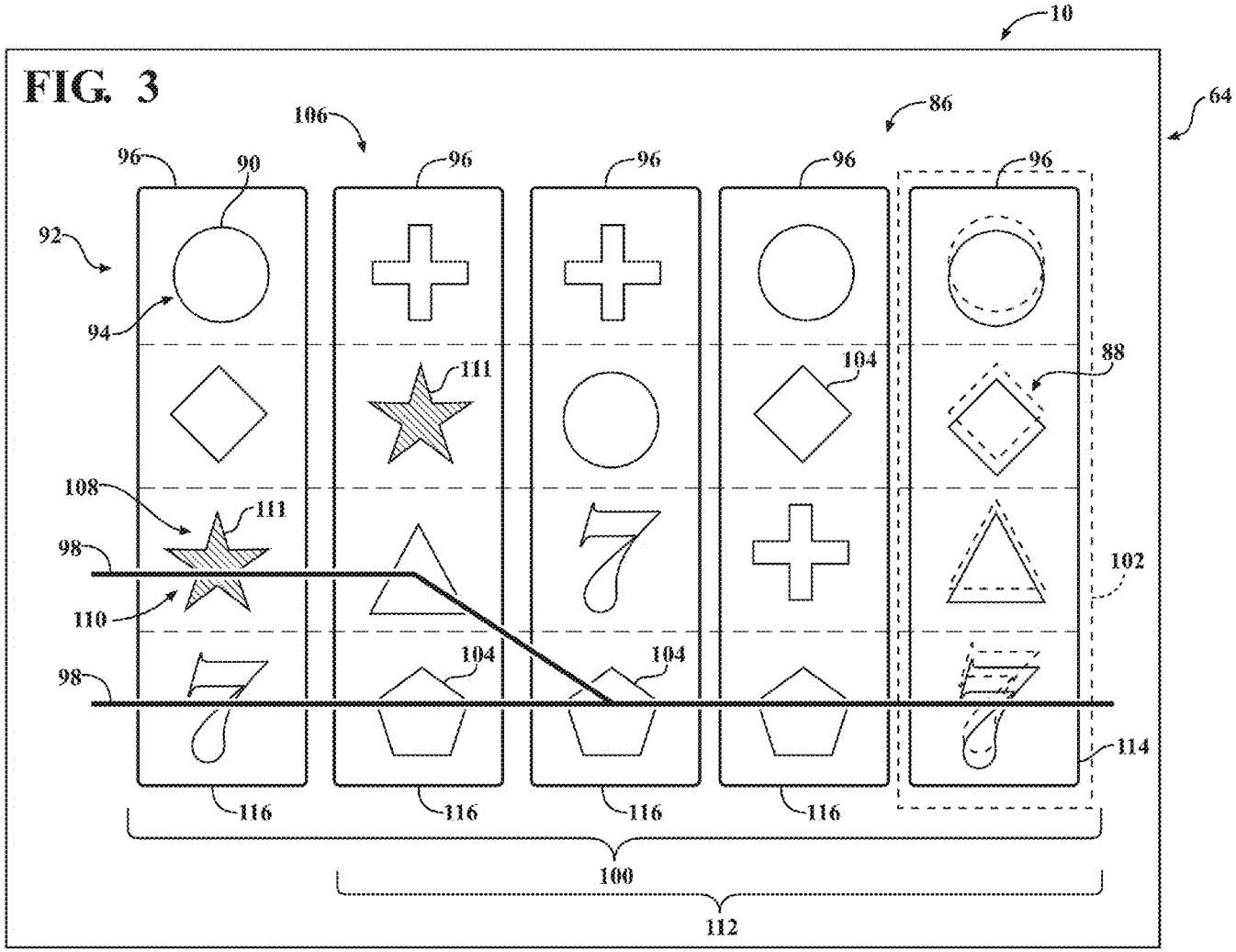
FIG. 3 is a graphical display of an exemplary video slot game, according to an embodiment of the present invention.

FIG. 3 is an exemplary graphical display of a primary game 86 that is displayed by the gaming machine 10. In the illustrated embodiment, the gaming controller 16 is configured to display the primary game 86 on the display device 12. In addition, the gaming controller 16 is configured to display an anticipation event, represented generally by line 88, a bonus feature (not shown), and/or a secondary game (not shown). The bonus feature and/or the secondary game may be substantially similar to the primary game 86. In one embodiment, the primary game 86 is a video slot game. However, it should be noted that the primary game 86 may be any type of game upon which a player could make a wager including, but not limited to a keno game, a blackjack game, a video poker game, or any type of game that enables the gaming machine 10 to function as described herein. In the illustrated embodiment, the primary game 86, the anticipation event 88, the bonus feature, and the secondary game are each displayed on the first display 60. Alternatively, the primary game 86, the anticipation event 88, the bonus feature, and/or the secondary game may be displayed on the first display 60, the second display 62, and/or partially displayed on each of the first and second displays 60 and 62.

In general, during play of the primary game 86, the gaming controller 16 randomly selects a plurality of game elements 90 such as, for example, video reel symbols, from a predefined set of possible game elements to be displayed on the display device 12. The gaming controller 16 displays each primary game 86 to include a plurality of game elements 90 that are displayed in a grid 92 having a plurality of cells 94 defined by rows and/or columns. Primary game 86, in one embodiment, includes 5 columns or reels 96 with 4 cells 94 per reel 96, respectively (a "5×4" arrangement). Alternatively, other video reel arrangements may be used, such as 4-5-5-5-4, 3-4-3-4-3, or 4-5-4-5-4 configurations or configurations with the same number of cells per column, such as 3×3, 3×4, 4×5, or 5×5 configurations.

Each video slot game is generally first played in a conventional manner. The player makes a wager, which may be based on a predetermined denomination and a selected number of paylines 98. The reels are spun and game symbols or elements are randomly chosen for each cell 94. If a predetermined pattern of elements 90 are randomly chosen for each cell 94 on a played payline 98, the player may be awarded a payout based on the selected payline, the wager, and a predetermined paytable. Moreover, the player may be awarded a payout if the combination of elements associated with a selected payline is a winning combination. In addition, a player may receive a bonus feature and/or a bonus game based on the combination of elements associated with the selected payline. Many variations to the above described general play of a video slot game fall within the scope of the present invention. Such video slot games are well-known in the art, and are therefore not further discussed.

The gaming machine 10 receives a signal, from the user input device 14, that is indicative of a player's selection to initiate a gaming session including a wager amount, and a selection of one or more paylines 98 associated with a predefined set 100 of cells 94 within the displayed grid 92. In the illustrated embodiment, the gaming machine 10 is a multiline game, i.e., the paylines include horizontal paylines and/or diagonal pay-lines, and/or zig-zag paylines. The user input device 14 may allow the player to toggle to increase the bet per payline a credit at a time (up to the maximum bet). The gaming controller 16 randomly generates an outcome 102 of the primary game 86, and displays the generated outcome 102 on the display device 12. In one embodiment, the gaming controller 16 is configured to rotate, and/or spin each reel 96 to initiate a game play, and stop each reel 96 to display a plurality of symbols 104 associated with the randomly generated outcome 102. In addition, the gaming controller 16 is adapted to determine if the generated outcome 102 is a winning outcome based on the displayed game elements 90, a paytable, a wager, and one or more selected paylines 98. More specifically, the gaming machine 10 determines if a combination of symbols 104 displayed in the set 100 of cells 94 associated with the selected payline 98 is a winning combination. The gaming controller 16 may provide an award in response to the outcome of the primary game 86. In general, the term "award" may be a payout, in terms of credits or money. Thus, the gaming controller 16 may award a regular payout in response to the outcome of the primary game 86. However, it should be noted that the term award may also refer to other types of awards, including, prizes, e.g., meals, show tickets, etc. . . . , as well as in-game award, such as free games or awarding the player one or more wild symbols or stacked wild symbols in each of the games.

In the illustrated embodiment, the gaming controller 16 is also configured to receive a player's wager associated with a first primary game 106, generate an outcome 102 of the first primary game 106, and determine if an anticipation event triggering condition 108 has occurred in the generated first primary game outcome. In the illustrated embodiment, the gaming controller 16 is configured to determine the anticipation event triggering condition 108 based at least in part on an anticipation event probability associated with the first primary game 106. In one embodiment, the gaming controller 16 is configured to determine if a preliminary triggering condition 110 has occurred in the primary game outcome 102, and determine the anticipation event triggering condition 108 if the preliminary triggering condition has occurred. Moreover, if the preliminary triggering event condition 110 has occurred, the gaming controller 16 then determines whether the anticipation event triggering condition 108 has occurred. In the illustrated embodiment, the preliminary triggering condition is the appearance of one or more scatter symbols 111 in one or more reels 96 displayed in the primary game outcome 102. In another embodiment, the preliminary triggering condition may be a predefined combination of symbols 104 that are indicative of a potential winning combination 112. Moreover, the preliminary triggering condition may include an appearance of one or more predefined winning symbols such as, for example a "wild" symbol representative of any symbol along one or more selected paylines 98. In one embodiment, the anticipation event triggering condition 108 may be the preliminary triggering condition. Alternatively, anticipation event triggering condition 108 may be any gaming condition such as, for example, any combination of symbols that occurs in the primary game outcome, or any suitable gaming condition that enables the gaming machine 10 to function as described herein.

The gaming controller 16 is also configured to display the anticipation event 88 on display device 12 during the display of the primary game outcome 102, if the anticipation event triggering condition 108 has occurred. The anticipation event 88 is configured to notify the player of a potential winning combination 112 in the primary game 86. The potential winning combination 112 may be associated with an award, a bonus feature, and/or a secondary game. The bonus feature may include, but is not limited to including, a credit bonus multiplier that increases an amount of an award, a free game play, one or more wild symbols or stacked wild symbols in each of the games, a secondary game, and/or any additional award or feature that enables the gaming machine 10 to function as described herein. The secondary game may include, but is not limited to including, a progressive game in which multiple players may be eligible in to win a, generally large, jackpot or payout. The jackpot or payout is generally funded from a pool which is added to through contributions from the wagers made by a plurality of players. Alternatively, the secondary game may be a bonus game that is substantially similar to the primary game 86, in which only the player who has triggered the secondary game may win, and the secondary jackpot or bonus is funded from the associated gaming machine 10.

In the illustrated embodiment, the anticipation event 88 includes rotating at least one reel 96 for a rotational period that is different than a rotational period of at least one other reel 96. More specifically, in one embodiment, gaming controller 16 is configured to display the first primary game 106 including a plurality of reels 96 that includes a first reel 114 and one or more second reels 116. The gaming controller 16 displays the anticipation event 88 including rotating the first reel 114 for a first rotational period, and rotating the second reel 116 for a second rotational period that is different than the first rotational period. Moreover, in one embodiment, gaming controller 16 rotates the first reel 114 for a first rotational period that is longer than the second rotational period of the second reels, which results in a "long-spin" of the first reel 114 to induce anticipation of a winning outcome to the player. Alternatively, the anticipation event 88 may include any suitable notification provided to the player to indicate a potential winning combination including, but not limited to, a notification displayed on display device 12, a lighting effect displayed by lighting devices 40, an audible notification, and/or any combination thereof.

Figure 4:
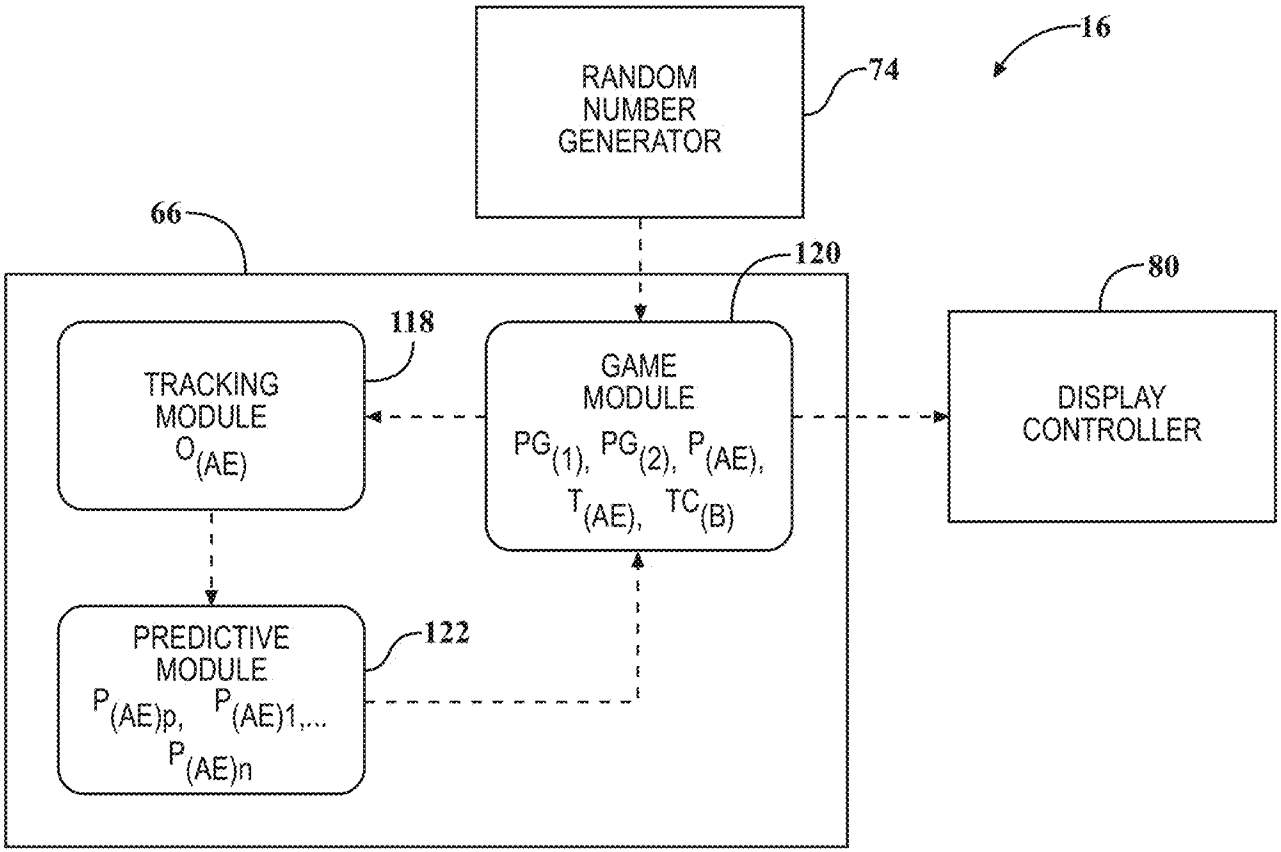
FIG. 4 is a partial schematic representation of an exemplary gaming controller that may be used with the gaming machine shown in FIG. 1.

FIG. 4 is a partial schematic representation of the gaming controller 16. In the illustrated embodiment, the CPU 66 includes a tracking module 118, a game module 120, and a predictive module 122. The game module 120 is configured to receive, from user input device 14, a signal indicative of the player's selection to initiate a first gaming session, and transmits a signal indicative of the first gaming session to the tracking module 118. The game module 120 also receives a signal, from user input device 14, that is indicative of a player's wager associated with the first primary game 106, and randomly generates a first primary game outcome ($PG_{(1)}$) based at least in part on the random numbers received from the RNG 74. Moreover, the game module 120 transmits a signal indicative of the generated primary game outcome 102 to display controller 80 to display the primary game outcome 102 to the player via the display device 12.

The game module 120 also receives an anticipation event probability value ($P_{(AE)}$) from the predictive module 122, and determines if an anticipation event trigger condition ($T_{(AE)}$) has occurred in the first primary game outcome ($PG_{(1)}$), based at least in part on the anticipation event probability value ($P_{(AE)}$). The game module 120 displays the anticipation event 88 via the display device 12 if the anticipation event triggering condition ($T_{(AE)}$) has occurred. If the anticipation event 88 is displayed during the first primary game 106, the game module 120 transmits a signal indicative of the occurrence of the anticipation event 88 to the tracking module 118. The tracking module 118 calculates an anticipation event occurrence value ($O_{(AE)}$) that is indicative of a number of anticipation events 88 that have occurred during the gaming session.

The predictive module 122, receives the calculated anticipation event occurrence value ($O_{(AE)}$) from the tracking module 118, and establishes a modified anticipation event probability ($P_{(AE)m}$) based on the calculated anticipation event occurrence value ($O_{(AE)}$). The game module 120 receives the modified anticipation event probability ($P_{(AE)m}$) from the predictive module 122 for use during a subsequent primary game to be played by the player. More specifically, the game module 120 receives a player's wager associated with a second primary game, generates a second primary game outcome ($PG_{(2)}$), and determines if an anticipation event trigger condition ($T_{(AE)}$) has occurred in the second primary game outcome ($PG_{(2)}$), based at least in part on the modified anticipation event probability value ($P_{(AE)m}$). Moreover, the predictive module 122 calculates a plurality of anticipation event probabilities ($P_{(AE)1}$), . . . , ($P_{(AE)m}$) that are associated with each primary game displayed by gaming machine 10 during a gaming session.

In one embodiment, the game module 120 determines if the preliminary triggering condition 110 has occurred in the first primary game outcome ($PG_{(1)}$), and then determines if the anticipation event trigger condition ($T_{(AE)}$) has occurred if the preliminary triggering condition 110 has occurred.

In another embodiment, the game module 120 determines if the generated first primary game outcome ($PG_{(1)}$) is a winning outcome, and displays the anticipation event 88 if the first primary game outcome ($PG_{(1)}$) is not a winning outcome, and the anticipation event trigger condition ($T_{(AE)}$) has occurred. Alternatively, the game module 120 may be configured to display the anticipation event 88 if the first primary game outcome ($PG_{(1)}$) is a winning outcome, and the anticipation event trigger condition ($T_{(AE)}$) has occurred.

In one embodiment, the predictive module 122 determines if the anticipation event 88 was displayed in the first primary game 106, and calculates the modified anticipation event probability ($P_{(AE)m}$) to be less than the anticipation event probability ($P_{(AE)1}$) associated with the first primary game 106. More specifically, the predictive module 122 reduces the anticipation event probability ($P_{(AE)}$) if the anticipation event 88 was displayed in a previous primary game. In addition, the predictive module 122 increases the anticipation event probability ($P_{(AE)}$) if the previous primary game outcome is a winning outcome.

In one embodiment, the game module 120 is configured to determine if a bonus feature triggering condition ($TC_B$) has occurred during the first primary game 106, and display a bonus feature if the bonus feature triggering condition ($TC_B$) has occurred. In addition, the game module 120 transmits a signal to the tracking module 118 indicative of an occurrence of the bonus feature. Moreover, the predictive module 122 establishes the modified anticipation event probability ($P_{(AE)m}$) to be greater than the first primary game event probability ($P_{(AE)1}$), if the bonus feature was displayed in the first primary game 106.

The predictive module 122 is also configured to receive a signal indicative of the initiation of a second gaming session that is different than the first gaming session, and transmit a predefined anticipation event probability ($P_{(AE)p}$) for use during the first primary game played after the initiation of the second gaming session. More specifically, the game module 120 determines if the first gaming session has ended, and receives a signal indicative of a player's selection to initiate a second gaming session that is different than the first gaming session. In the illustrated embodiment, a gaming session may be terminated by a player selecting a payout, or a gaming session may be timed out by not receiving a player's input for a predefined period of time. The game module 120 sends a signal indicative of the second gaming session to the tracking module 118 and to the predictive module 122. The predictive module 122 establishes an initial anticipation event probability ($P_{(AE)}$) associated with the second gaming session that is equal to a predefined anticipation event probability ($P_{(AE)p}$). The tracking module 118 calculates a number of anticipation events 88 that have occurred in the second gaming session, and transmits an anticipation event occurrence value ($O_{(AE)}$) associated with the second gaming session to the predictive module 122.

Figure 5:
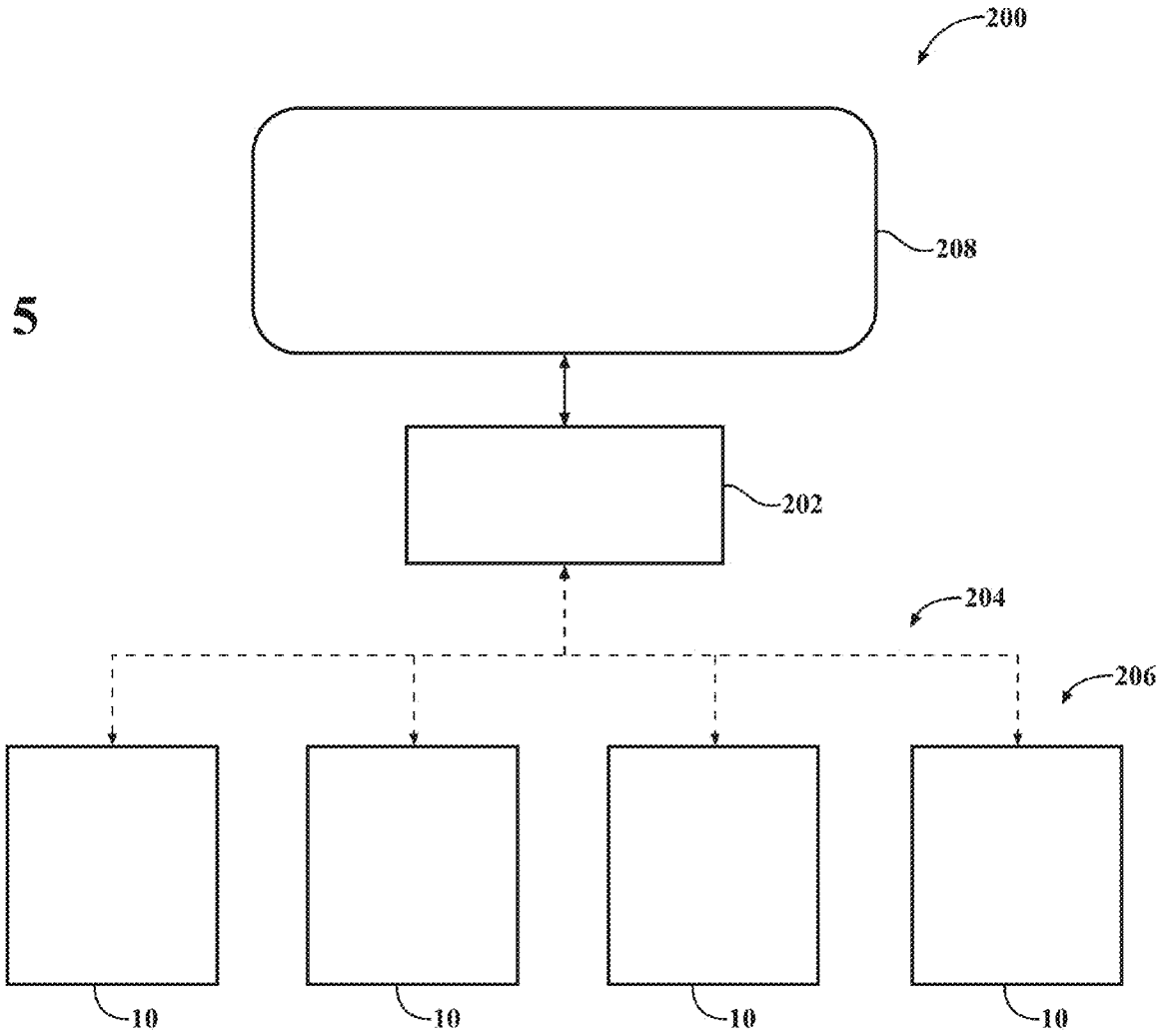
FIG. 5 is a schematic view of an exemplary gaming system of the present invention.

FIG. 5 is a schematic view of an exemplary gaming system 200. The gaming system 200 includes a plurality of linked gaming machines 10, and a system controller 202 that is coupled to each gaming machine 10. In one embodiment, each gaming machine 10 and the system controller 202 are coupled in a local area network (LAN) 204. Alternatively, each gaming machine 10 and the system controller 202 may be coupled via a network such as, for example, an Internet link, an intranet, a WAN, dial-in-connections, cable modems, wireless modems, and/or ISDN lines. In the illustrated embodiment, the gaming system 200 includes four gaming machines 10, which in one embodiment as shown in FIG. 5 are arranged in a bank 206, i.e., are arranged together, adjacently. It should be noted, however, that the gaming system 200 may include any number of gaming machines 10 that may be arranged in any manner, such as in a circle or along a curved arc, or positioned within separate areas of a casino floor, and/or separate gaming establishments such as different casinos. Furthermore, additional groups of gaming machines 10 may be coupled to the system controller 202. In one embodiment, the system controller 202 may be implemented by one of the game controllers 16 associated with a gaming machine 10. In still another embodiment, the system controller 202 may be located remotely with respect to the gaming machines 10, or within one of the gaming machine cabinet assemblies 18 (shown in FIG. 1), and may be configured to perform all of the functions of the gaming controllers 16 for each gaming machine 10 and the system controller 202.

In the illustrated embodiment, the system controller 202 includes CPU 66 and memory device 82. The system controller 202 is configured to receive a signal indicative of the player's selection to initiate a first gaming session on an associated gaming machine 10, receive a signal indicative of the player's wager associated with the first primary game 106 (shown in FIG. 3), generate an outcome of the first primary game 106, and award the player an award if the first primary game outcome is a winning outcome. The system controller 202 also determines if an anticipation event triggering condition 108 has occurred based at least in part on an anticipation event probability associated with the first primary game 106, and display an anticipation event 88 (shown in FIG. 3) on the associated display device 12 if the anticipation event triggering condition 108 has occurred. The system controller 202 is also configure to calculate a number of anticipation events 88 that have occurred during the first gaming session of the associated gaming machine 10, and modify the anticipation event probability based at least in part on the number of anticipation events that have occurred.

In addition, the system controller 202 is configured to receive a player's wager associated with a second primary game on the associated gaming machine 10 after displaying the first primary game outcome, generate an outcome of the second primary game, and determine if the anticipation event triggering condition 108 has occurred in the second primary game based at least in part on the modified anticipation event probability.

The system controller 202 is also configured to determine if a bonus feature triggering condition has occurred during the first primary game 106, and displaying a bonus feature on the associated gaming machine 10 if the bonus feature triggering condition has occurred. In one embodiment, the system controller 202 determines whether a bonus triggering event has occurred in one or more of the linked gaming machines 10, and displays a secondary game, and/or a bonus feature on each linked gaming machine 10 being played.

In the illustrated embodiment, the gaming system 200 includes a second display device 208. The system controller 202 is operatively coupled to the second display device 208 to display the secondary game and/or bonus feature on the second display device 208. The secondary game may include, but is not limited to including, a progressive game in which multiple players may be eligible in to win a, generally large, jackpot or payout.

Figure 6:
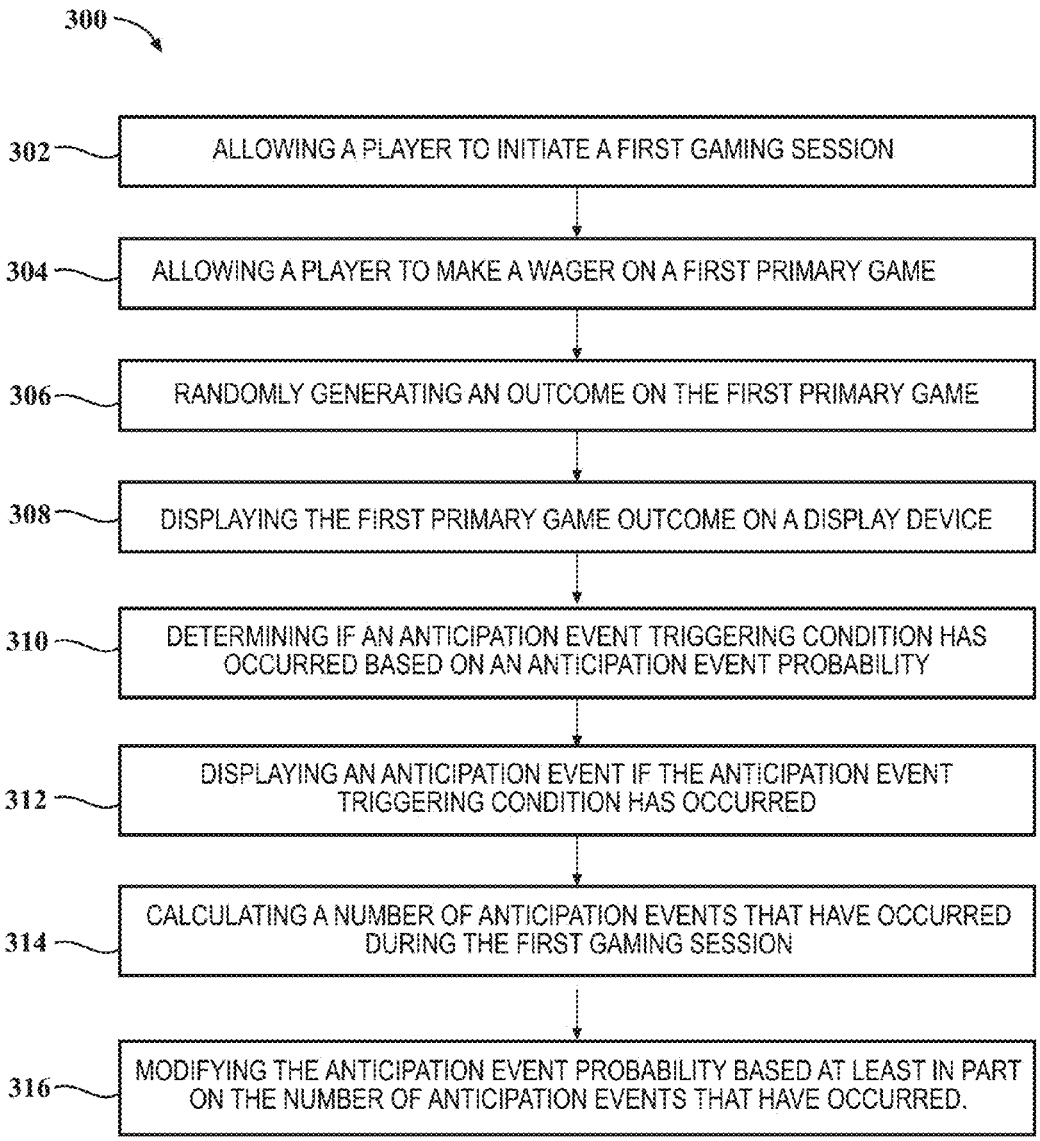
FIG. 6 is a flowchart of an exemplary method of allowing a player to play a gaming machine, according to an embodiment of the present invention.

FIG. 6 is a flowchart of an exemplary method 300 of allowing a player to play gaming machine 10. Method 300 includes the steps of allowing 302 a player to initiate a first gaming session, allowing 304 a player to make a wager on a first primary game, randomly generating 306 an outcome of the first primary game, displaying 308 the first primary game outcome on the display device 12, determining 310 if an anticipation event triggering condition has occurred based at least in part on an anticipation event probability associated with the first primary game, and displaying 312 an anticipation event on the display device if the anticipation event triggering condition has occurred. The method also includes the steps of calculating 314 a number of anticipation events that have occurred during the first gaming session, and modifying 316 the anticipation event probability based at least in part on the number of anticipation events that have occurred.

In one embodiment, the method includes determining if a preliminary triggering condition has occurred in the first primary game outcome, and determining if the anticipation event triggering condition has occurred, if the preliminary triggering condition has occurred.

In another embodiment, the anticipation event is displayed if the first primary game outcome is not a winning outcome and the anticipation event triggering condition has occurred. Alternatively, the anticipation event is displayed if the first primary game outcome is a winning outcome and the anticipation event triggering condition has occurred.

The method 300 may also include the steps of allowing a player to make a wager on a second primary game after displaying the first primary game outcome, and determining if the anticipation event triggering condition has occurred based at least in part on the modified anticipation event probability. In one embodiment, the modified anticipation event probability is less than the first primary game anticipation event probability if the anticipation event was displayed in the first primary game. In another embodiment, the modified anticipation event probability is approximately equal to the first primary game anticipation event probability if the anticipation event was not displayed in the first primary game.

In the illustrated embodiment, the method 300 also includes determining if the first gaming session has ended, allowing a player to initiate a second gaming session, and establishing an anticipation event probability associated with the second gaming session that is equal to a predefined anticipation event probability. In addition, the method 300 includes the step of determining if a bonus feature triggering condition has occurred during the first primary game, and displaying a bonus feature if the bonus feature triggering condition has occurred. In one embodiment, the modified anticipation event probability is greater than the first primary game anticipation event probability if the bonus feature has been displayed.

The above-described systems and methods overcome at least some disadvantages of known gaming machines by providing a gaming machine that displays an anticipation event associated with a potential winning outcome and/or bonus feature during game play, and modifies the probability of the anticipation event occurring during subsequent game plays. Moreover, the embodiment, described herein calculates the number of anticipation events that have occurred during a gaming session, and modifies the anticipation event probability used during subsequent game plays based at least in part on the number of anticipation events that have previously occurred. By modifying the probability of the anticipation event occurring during subsequent game plays, the enjoyment of the game play is improved, and the amount of time that the gaming machine is played by patrons of a gaming establishment is thereby increased.

Exemplary embodiments of a gaming machine, a gaming system, and a method of allowing a player to play a gaming machine are described above in detail. The gaming machine, system, and method are not limited to the specific embodiments described herein, but rather, components of the gaming machine and/or system and/or steps of the method may be utilized independently and separately from other components and/or steps described herein. For example, the gaming machine may also be used in combination with other gaming systems and methods, and is not limited to practice with only the gaming machine as described herein. Rather, an exemplary embodiment can be implemented and utilized in connection with many other gaming system applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A method of allowing a player to play a gaming machine including a display device and a controller, comprising the steps of:

allowing a player to initiate a first gaming session, the first gaming session including one or more primary games to be played on the gaming machine, each primary game including a plurality of reels being displayed with a plurality of symbols displayed in a grid, at least one primary game including a game outcome being displayed with an anticipation event for notifying the player of a perceived potential winning combination of symbols in the primary game outcome;

allowing a player, through an input device which accepts physical media indicating a monetary value, to make a wager on a first primary game and responsively initiating the first primary game;

randomly generating, by the controller, an outcome of the first primary game and displaying the outcome of the first primary game on the display device;

calculating, by the controller, a number of previous primary game outcomes displayed with the anticipation event during the first gaming session and determining a first anticipation event probability associated with the first primary game as a function of the calculated number of previous primary games displayed with the anticipation event;

determining, by the controller, if an anticipation event triggering condition has occurred with the outcome of the first primary game based at least in part on the first anticipation event probability and responsively display the anticipation event with the outcome of the first primary game if the anticipation event triggering condition occurs;

awarding the player an award if the outcome of the first primary game is a winning outcome;

generating a second anticipation event probability if the anticipation event is displayed with the outcome of the first primary game;

randomly generating an outcome of a second primary game;

determining if the anticipation event triggering condition has occurred in the outcome of the second primary game as a function of the second anticipation event probability; and responsively displaying the anticipation event with the outcome of the second primary game if the anticipation event triggering condition occurs.

2. The method in accordance with claim 1, wherein the anticipation event is displayed if the first primary game outcome is not a winning outcome and the anticipation event triggering condition has occurred.

3. The method in accordance with claim 1, wherein the anticipation event is displayed if the first primary game outcome is a winning outcome and the anticipation event triggering condition has occurred.

4. The method in accordance with claim 1, wherein the second anticipation event probability is greater than the first anticipation event probability.

5. The method in accordance with claims 1, wherein the second anticipation event probability is less than the first anticipation event probability if the anticipation event was displayed in the outcome of first primary game.

6. The method in accordance with claim 1, wherein the anticipation event triggering condition includes a potential winning outcome being displayed with the first primary game outcome.

7. The method in accordance with claim 1, further comprising the steps of:

determining if the first gaming session has ended;

allowing a player to initiate a second gaming session; and establishing an initial anticipation event probability associated with the second gaming session that is equal to a predefined anticipation event probability.

8. The method in accordance with claim 1, further comprising the step of determining if a bonus feature triggering condition has occurred during the first primary game, and displaying a bonus feature if the bonus feature triggering condition has occurred, wherein the second anticipation event probability is based at least in part on whether the bonus feature has been displayed in the first primary game.

9. The method in accordance with claim 8, wherein the second anticipation event probability is greater than the first anticipation event probability if the bonus feature has been displayed.

10. The method in accordance with claim 1, wherein said displaying the anticipation event further comprises the step of displaying a notification indicative of a potential winning outcome.

11. The method in accordance with claim 10, wherein the plurality of reels including a first reel and one or more second reels, said displaying the anticipation event further comprising the steps of:

rotating the first reel for a first rotational period; and rotating the second reel for a second rotational period that is different than the first rotational period.

12. A gaming machine, comprising:

a display device;

a user input device which accepts physical media indicating a monetary value; and a controller coupled to the display device and the user input device, the controller configured to:

receive, from the user input device, a signal indicative of a player's selection to initiate a first gaming session, the first gaming session including one or more primary games to be played on the gaming machine, each primary game including a plurality of reels being displayed with a plurality of symbols displayed in a grid, at least one primary game including a game outcome being displayed with an anticipation event for notifying the player of a perceived potential winning combination of symbols in the primary game outcome;

receive a signal indicative of a player's wager associated with a first primary game;

generate an outcome of the first primary game and display the outcome of the first primary game on the display device;

calculate a number of previous primary game outcomes displayed with the anticipation event during the first gaming session and determine a first anticipation event probability associated with the first primary game as a function of the calculated number of previous primary games displayed with the anticipation event;

determine if an anticipation event triggering condition has occurred with the outcome of the first primary game based at least in part on the first anticipation event probability and responsively display the anticipation event on the display device with the outcome of the first primary game if the anticipation event triggering condition occurs;

award the associated player an award if the outcome of the first primary game is a winning outcome;

generate a second anticipation event probability if the anticipation event is displayed with the outcome of the first primary game;

randomly generate an outcome of a second primary game;

determine if the anticipation event triggering condition has occurred in the outcome of the second primary game as a function of the second anticipation event probability; and responsively display the anticipation event with the outcome of the second primary game if the anticipation event triggering condition occurs.

13. The gaming machine in accordance with claim 12, wherein the anticipation event is displayed if the first primary game outcome is not a winning outcome and the anticipation event triggering condition has occurred.

14. The gaming machine in accordance with claim 12, wherein the anticipation event is displayed if the first primary game outcome is a winning outcome and the anticipation event triggering condition has occurred.

15. The gaming machine in accordance with claim 12, wherein the second anticipation event probability is greater than the first anticipation event probability.

16. The gaming machine in accordance with claim 12, wherein the anticipation event triggering condition includes a potential winning outcome being displayed with the first primary game outcome.

17. The gaming machine in accordance with claim 12, wherein the controller is further configured to:

determine if the first gaming session has ended;

receive a signal indicative of a player's selection to initiate a second gaming session; and establish an initial anticipation event probability associated with the second gaming session that is equal to a predefined anticipation event probability.

18. The gaming machine in accordance with claim 12, wherein said controller is further configured to determine if a bonus feature triggering condition has occurred during the first primary game, and display a bonus feature if the bonus feature triggering condition has occurred, wherein the second anticipation event probability is based at least in part on whether the bonus feature has been displayed in the first primary game.

19. The gaming machine in accordance with claim 18, wherein the second anticipation event probability is greater than the first anticipation event probability if the bonus feature has been displayed.

20. The gaming machine in accordance with claim 12, wherein said controller is further configured to display the anticipation event including a notification indicative of a potential winning outcome.

21. The gaming machine in accordance with claim 20, wherein said controller is further configured to:

display the plurality of reels including a first reel and one or more second reels; and display the anticipation event including rotating the first reel for a first rotational period, and rotating the second reel for a second rotational period that is different than the first rotational period.

22. A gaming system, comprising:

a plurality of gaming machines, each gaming machine including a user selection input device which accepts physical media indicating a monetary value, a display device, and a game controller for allowing an associated player to initiate a gaming session on an associated gaming machine; and a system controller coupled to each gaming machine, said system controller configured to:

receive a signal indicative of the player's selection to initiate a first gaming session, the first gaming session including one or more primary games to be played on the gaming machine, each primary game including a plurality of reels being displayed with a plurality of symbols displayed in a grid, at least one primary game including a game outcome being displayed with an anticipation event for notifying the player of a perceived potential winning combination of symbols in the primary game outcome;

receive a signal indicative of the player's wager associated with the first primary game;

generate an outcome of the first primary game and display the outcome of the first primary game on the display device;

calculate a number of previous primary game outcomes displayed with the anticipation event during the first gaming session and determine a first anticipation event probability associated with the first primary game as a function of the calculated number of previous primary games displayed with the anticipation event;

determine if an anticipation event triggering condition occurs with the outcome of the first primary game based at least in part on the first anticipation event probability and responsively display the anticipation event on the associated display device with the outcome of the first primary game if the anticipation event triggering condition occurs;

award the associated player an award if the outcome of the first primary game is a winning outcome;

generate a second anticipation event probability if the anticipation event is displayed with the outcome of the first primary game;

randomly generate an outcome of a second primary game;

determine if the anticipation event triggering condition has occurred in the outcome of the second primary game as a function of the second anticipation event probability; and responsively display the anticipation event with the outcome of the second primary game if the anticipation event triggering condition occurs.

23. The gaming system in accordance with claim 22, wherein the second anticipation event probability is greater than the first anticipation event probability.

24. The gaming system in accordance with claim 23, wherein the system controller is further configured to:

determine if the first gaming session has ended;

receive a signal indicative of a player's selection to initiate a second gaming session; and establish an initial anticipation event probability associated with the second gaming session that is equal to a predefined anticipation event probability.

25. The gaming system in accordance with claim 23, wherein said system controller is further configured to determine if a bonus feature triggering condition has occurred during the first primary game, and displaying a bonus feature if the bonus feature triggering condition has occurred, wherein the second anticipation event probability is based at least in part on whether the bonus feature has been displayed in the first primary game.

26. The gaming system in accordance with claim 22, wherein said system controller is further configured to display the anticipation event including a notification indicative of a potential winning outcome.

27. The gaming system in accordance with claim 26, wherein said system controller is further configured to:

display the plurality of reels including a first reel and one or more second reels; and display the anticipation event including rotating the first reel for a first rotational period, and rotating the second reel for a second rotational period that is different than the first rotational period.

* * * * *